US005577811A

United States Patent [19]

Ogg

[11] Patent Number: 5,577,811

[45] Date of Patent: Nov. 26, 1996

[54] ERGONOMIC CHAIR

[75] Inventor: Richard K. Ogg, Littlestown, Pa.

[73] Assignee: Hon Industries Inc., Muscatine, Iowa

[21] Appl. No.: 482,068

[22] Filed: Jun. 7, 1995

[51] Int. Cl.[6] ..... A47C 7/16

[52] U.S. Cl. ..... 297/452.15; 297/284.4; 297/452.31; 297/452.14

[58] Field of Search ..... 297/302.1, 451.1, 297/284.4, 452.15, 452.14, 452.25, 452.31, 452.34, 452.36, 320, 440.22

[56] References Cited

U.S. PATENT DOCUMENTS

| | | | |
|---|---|---|---|
| 1,210,223 | 12/1916 | Silbert . | |
| 3,177,036 | 4/1965 | Halter . | |
| 3,583,759 | 6/1971 | Kramer | 297/452.15 X |
| 3,883,176 | 5/1975 | Morton . | |
| 4,032,190 | 6/1977 | Muller-Deisig et al. . | |
| 4,047,757 | 9/1977 | Eames et al. . | |
| 4,123,105 | 10/1978 | Frey | 297/451.1 |
| 4,489,982 | 12/1984 | Morrow . | |
| 4,500,137 | 2/1985 | Morehouse . | |
| 4,660,887 | 4/1987 | Fleming et al. | 297/452.15 X |
| 4,856,846 | 8/1989 | Lohmeyer . | |
| 4,871,208 | 10/1989 | Hodgdon . | |
| 5,015,038 | 5/1991 | Mrotz, III | 297/452.15 |
| 5,102,196 | 4/1992 | Kaneda et al. | 297/452.15 |
| 5,181,764 | 1/1993 | Wiener | 297/452 |

FOREIGN PATENT DOCUMENTS

| | | | |
|---|---|---|---|
| 1118414 | 11/1961 | Germany | 297/452.15 |
| 2932134 | 2/1981 | Germany | 297/452.36 |
| 3116459 | 11/1982 | Germany | 297/302 |
| 3800751 | 8/1988 | Germany | 297/302 |
| 4216358 | 11/1992 | Germany | 297/452.15 |
| 2041735 | 9/1980 | United Kingdom | 297/320 |

*Primary Examiner*—Peter M. Cuomo
*Assistant Examiner*—David E. Allred
*Attorney, Agent, or Firm*—Jones, Day, Reavis & Pogue

[57] ABSTRACT

A chair comprises an integrally formed shell having a horizontal portion and a vertical portion. A seat pan is supported on resilient arms formed integrally with the shell. A pair of independently flexible arms of the vertical shell portion are formed integrally with shoulder support members. The resilience of the shoulder support arms and seat pan support arms provides a chair which is highly passive to the body movements of the user.

18 Claims, 4 Drawing Sheets

ERGONOMIC CHAIR

BACKGROUND OF THE INVENTION

1. Field of the Invention

The present invention relates generally to chair construction and more particularly, to an ergonomically designed chair of the type primarily used in offices and having a construction which affords improved support for both the pelvic region and back of the chair occupant.

2. Description of the Prior Art

Many chairs of common design having a horizontal seat member and vertical back member do not provide support for the shoulder blades, the lumbar region of the spine and the pelvic region of the chair user. When in a standing position, the weight of a person's torso is supported by the hip bones and thus the shoulder muscles, the back muscles in the lumbar region and the muscles in the pelvic region have minimal load applied to them. However, in a seated position, as the thigh bones move upwardly, the pelvis of the chair user shifts posteriorly requiring the use of muscles to support the pelvic region, the lumbar region and shoulder blades. A typical chair has a back support member usually positioned above the seat and adapted to provide some support for the small of the user's back. However, the shoulder blades and pelvic region are usually unsupported, and after an extended period of time this can result in fatigue of the user's muscles thereby causing discomfort and pain.

In order to provide better back support of a chair user, it is known in the art to position a back pillow only slightly above the seat of the chair such that the pillow projects convexly forward over the rear seat area at the elevation of the ilia and sacrum with the person's back substantially unsupported in the lumbar region. Such a chair is disclosed, for example, in U.S. Pat. No. 4,489,982 issued to Morrow. As disclosed therein, this chair has the capability of maintaining the pelvis of the user at a sufficient sacral base angle that substantially the entire weight of the upper portion of the body of the user is supported by the seat of the chair.

However, a disadvantage of the foregoing chair is that the shoulders and lumbar region of the user are completely unsupported, requiring the user to maintain continuously an erect posture while seated. Should the user shift position, such as after an extended period of sitting, the support provided by the pillow can be completely ineffectual in maintaining the back of the user erect, causing arching of the spine and resulting dependence on back muscles to support the user while seated. Consequent muscle fatigue and associated pain thereby manifests itself particularly when the user is seated in the chair over long periods of time.

Accordingly, it is desirable to provide an improved chair, of the type used in an office setting for example, which provides support for the ilia and sacrum of the user while at the same time supporting the user's shoulder blades. It is further desirable to provide such a chair with the ability to allow for independent support of each shoulder blade as the user's torso rotates while seated in the chair. Still further, it is desirable to provide such a chair having a seat member which separately supports each leg of the user while allowing the legs to assume different vertical positions relative to one another. Further, it is desirable to provide such a chair with a construction involving relatively few components so that economies in manufacturing the chair can be realized.

SUMMARY OF THE INVENTION

The present invention overcomes the disadvantages of the prior art by providing a chair comprising a unitary shell having a generally horizontal portion and a generally vertical portion. A separate seat member is connected to the horizontal portion of the shell by three resilient arms formed integrally with the shell. The seat member includes a vertical sacral support member which is spaced forwardly of the shell. The vertical portion of the shell includes a back support portion independent of the sacral support member for supporting the shoulder blades of the chair occupant.

Preferably, the back support portion comprises two horizontally spaced pad portions each connected to a resilient arm portion so that the pad portions can deflect independently as the chair user rotates in the chair. The seat member is also partially split from a forward edge and the split portions flex allowing the user's legs to independently assume differing relative vertical positions. In another aspect of the invention, the forward portion of the shell includes a downwardly curving tongue which mates with a cooperating slot formed in a yoke assembly. The yoke assembly includes a pair of rearwardly directed spring arms which engage the underside of the shell and bias the shell against rearward pivoting movement relative to the chair base.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
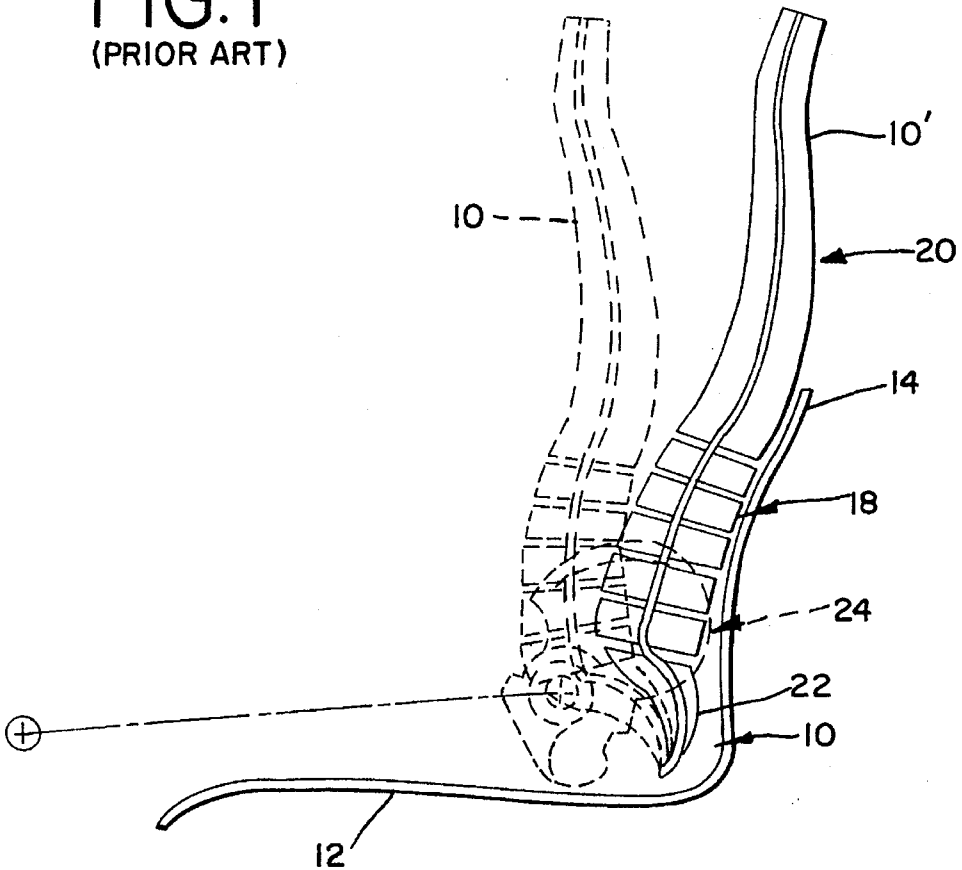
FIG. 1 (PRIOR ART)
FIG. 1 a schematic side view of a typical prior art chair illustrating the position of the spinal column of a person seated in the chair.

Referring now to the drawings, and initially to FIG. 1, a side view of a typical prior art chair is illustrated in schematic form and designated generally by the reference numeral 10. The chair 10 includes a seat portion 12 and a back portion 14. A diagrammatic spinal column 16 illustrates the posture of a person seated in an erect position in the chair 10. A second diagrammatic spinal column 16' depicts the posture of a person as the person leans back in the chair 10. As can be seen from the latter depiction of spinal column 16', a typical prior art chair 10 may provide some support for lumbar region 18 of the spine. However, there is no support provided for the upper back 20 in the region of the shoulder blades, nor for the ilia 22 and pelvic region 24.

Figure 2:
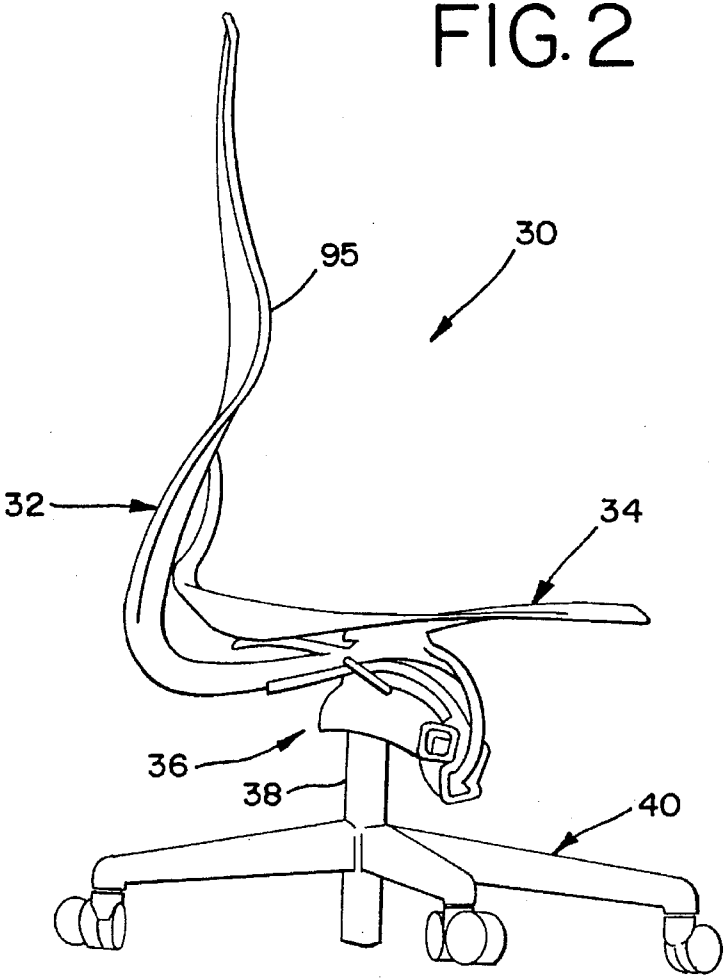
FIG. 2 is a right side elevational view of a chair constructed in accordance with the principles of the present invention.

Turning now to FIG. 2, a chair in accordance with the present invention is designated generally by the reference numeral 30 and includes a unitary shell 32 and a separately formed seat member 34. The shell 32 is connected to a yoke assembly 36 in a manner which will be described in detail, hereinafter. The yoke assembly 36, in turn, is mounted on a pedestal 38 which extends upwardly from a typical star base 40.

Figure 3:
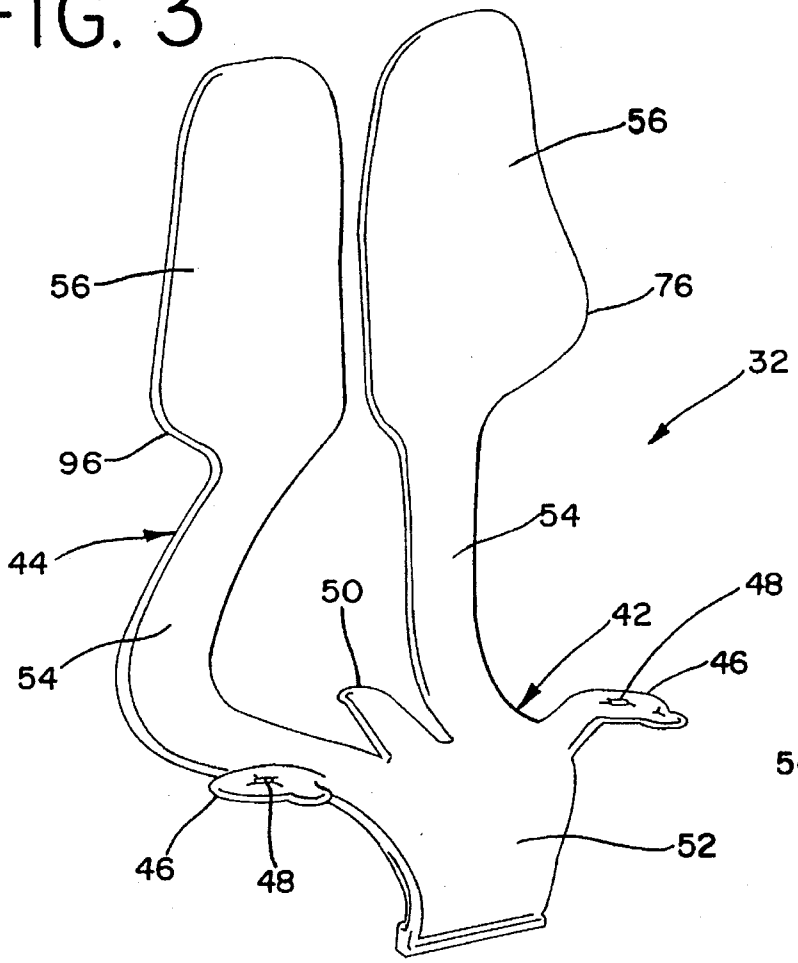
FIG. 3 is a front perspective view of the shell of the chair illustrated in FIG. 2.

In FIG. 3, the details of the shell 32 can be seen. The shell 32 comprises a generally horizontally disposed portion 42 and a generally vertically disposed portion 44. The generally horizontally disposed portion 42 provides support for the seat member 34. To this end, the portion 42 comprises a pair of laterally extending arms 46 having apertures 48 formed therethrough for receiving suitable fasteners (not shown). A generally rearwardly extending arm 50 is also provided for engaging the underside of the seat member 34. Thereby, the seat member 34 is supported on the shell 32 by a three-point support system. At the forward portion of the shell 32, the shell 32 is provided with an integrally-formed tongue 52 curving generally downwardly.

Curving upwardly from the horizontal portion 42 of the shell 52 at the rear of the chair 30 are a pair of arms 54. The arms 54, which define part of the vertically disposed portion 44 of the shell 32, each join into an upper shoulder support member 56. The members 56 are configured such that they are separated and closely horizontally spaced from one another.

Figure 4:
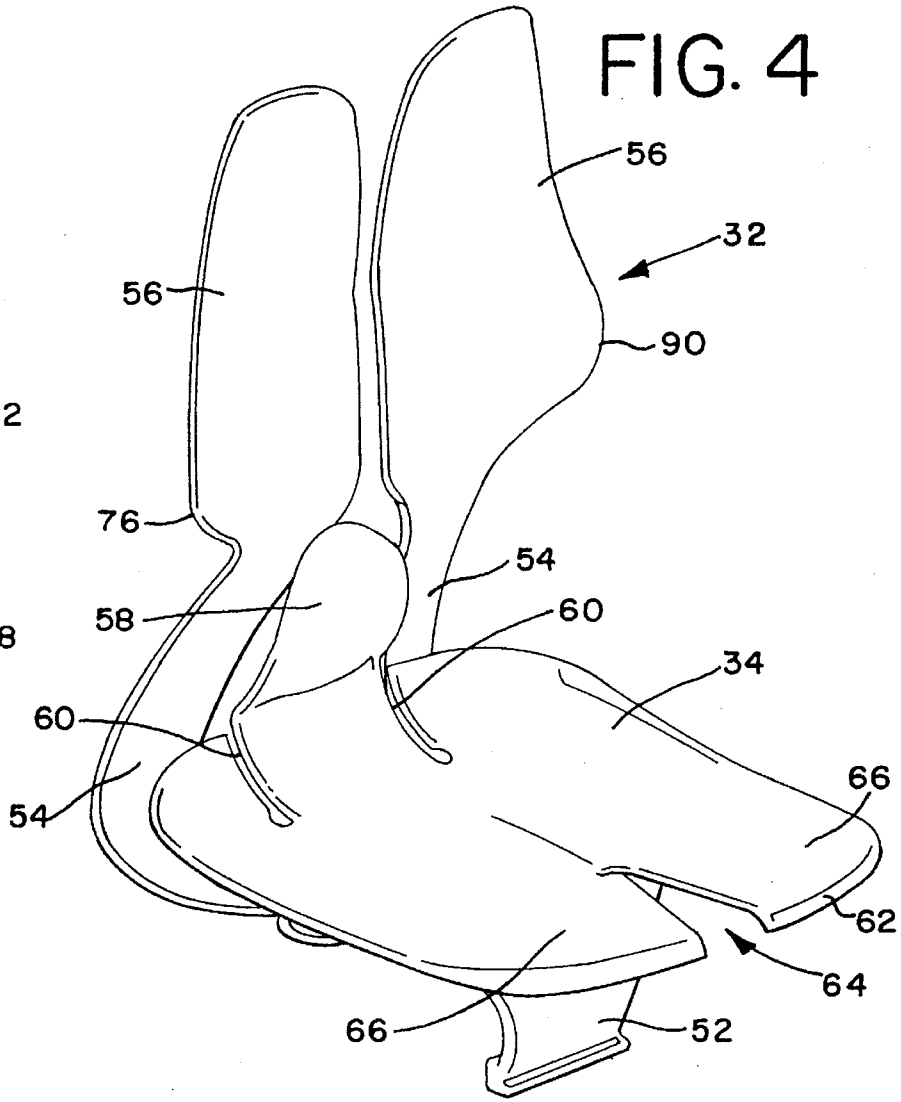
FIG. 4 is a front perspective view of the seat and shell assembly of the chair of the present invention.

Turning now to FIG. 4, the seat member 34 is shown as attached to the shell 32. The seat member 34 includes an upwardly extending integrally-formed sacral support portion 58 disposed at the rear of the seat member 34. Slots 60 are formed in the seat member, one on each side of the sacral support portion 58 to allow for flexibility of the sacral support portion 58. Extending rearwardly from forward edge 62 of the seat member 34 is a slot 64 in the seat member 34 which serves to provide independent flexibility to two forward halves 66 of the seat member 34.

Figure 5:
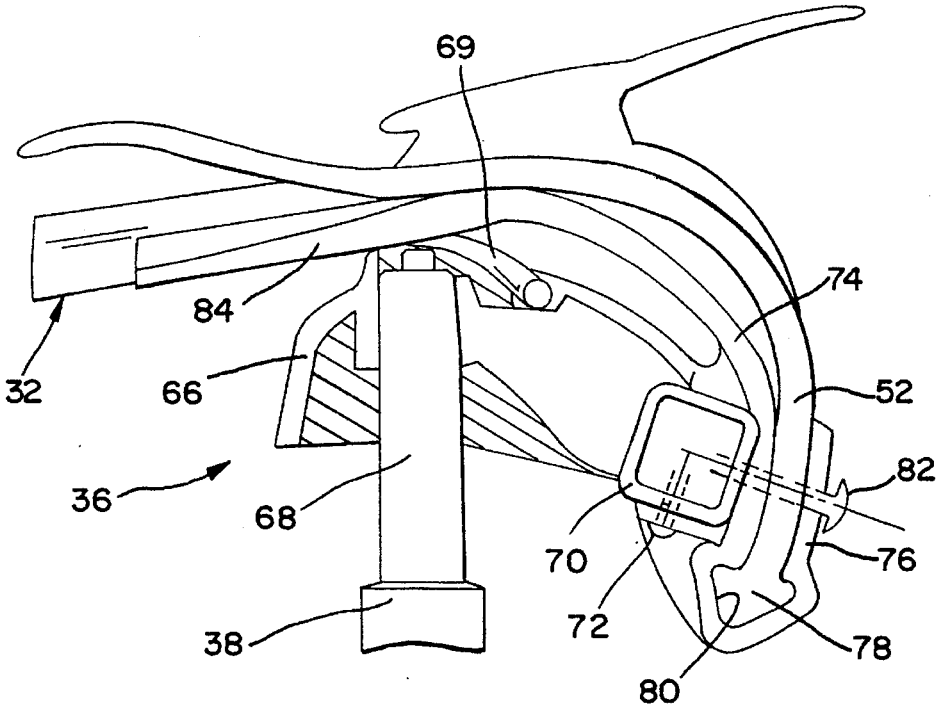
FIG. 5 is a cross-sectional view of a yoke assembly used in the present chair.
Figure 6:
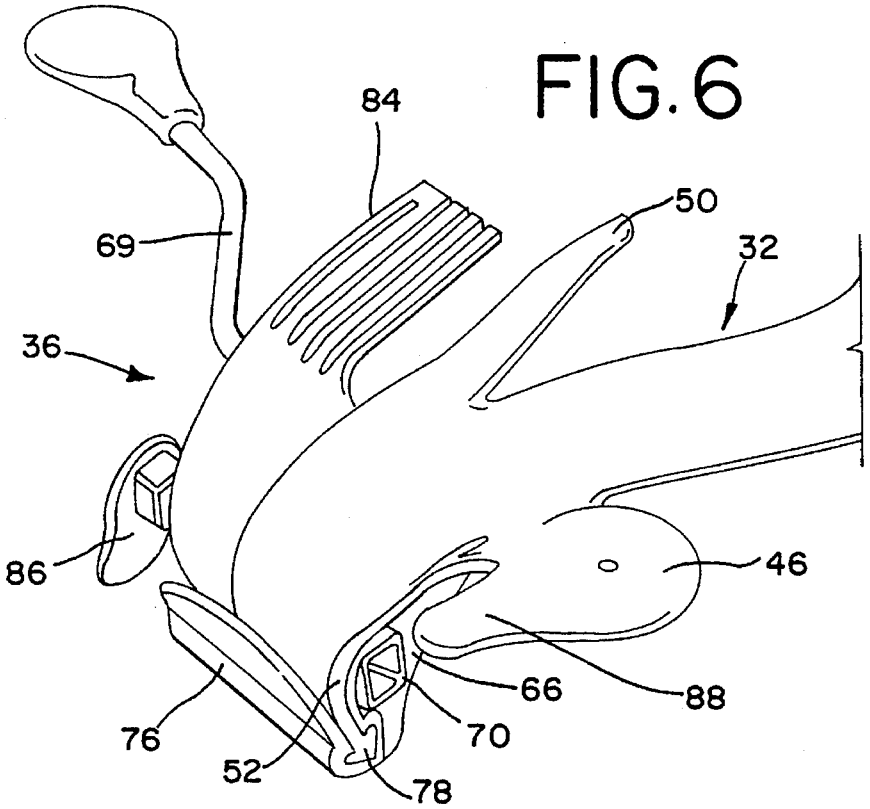
FIG. 6 is a partial perspective view of the yoke assembly shown as connected to the shell with the shell shown broken away.

Referring now to FIGS. 5 and 6, the yoke assembly 36 for connection of the shell 32 to the base pedestal 38 includes a yoke member 66 which is preferably die cast from suitable metal and compression fitted to a manually operable gas cylinder 68. The cylinder 68 is of a type well-known in the art used for permitting selective height adjustment of the chair. A suitable lever 69 may be used to actuate the cylinder 68. Forwardly of the cylinder 68, the yoke member 66 is formed with an integral channel portion 70 running transversely of the chair 30. Connected to the channel portion 70 by a suitable fastener 72 is a combined spring arm and latch member 74. This member 74 has a forward latch portion 76 which serves to engage the tongue 52 of the shell 32. Engagement of the tongue 52 is provided by the cooperation of an enlarged end 78 of the tongue 52 and a correspondingly configured slot 80 defined by the latch member 76. One or more fasteners 82 may be used to secure the tongue 52 and latch member 76 to the transverse channel portion 70 of the yoke member 66 thereby locking the tongue 52 in place in the latch member 74.

The member 74 also includes a pair of spring arm portions 84 which curve upwardly and rearwardly over the yoke member 66. The arm portions 84, one of which can best be seen in the cut-away drawing of FIG. 6, are configured to engage the underside of the shell 32 and thereby bias the shell 32 while permitting the shell 32 to pivot relative to the base 40. A pair of suitable caps 86 may be used to cover the ends of the channel 70, the ends of the latch portion 76 and the ends of the tongue 52, thereby giving the yoke assembly 36 a more finished appearance.

It can now be appreciated that the chair 30 of the present invention offers considerable improvements over prior art chair constructions. Preferably, all components of the chair 30, except the die cast yoke member 66, are molded from an engineering polymer, and ideally from a polymer which is one-third glass filled. By this construction, the seat member 34, for example, is a highly flexible resilient member in which the sacral support portion 58 can pivot front to back of the chair 30 and thereby apply uniform pressure to the sacral area of the chair 30 user as the user's position in the chair 30 shifts. Further, the two forward halves 66 of the seat member 34 are resiliently flexible such that they can independently support the legs of the chair user at differing vertical positions.

The shell 32 has a number of novel features due to its resilient construction. For example, the three-point support provided by the arms 46 and 50 allows for flexing of the seat 34 to adjust to the position of the user. It should also be noted that arms 46, as best seen in FIG. 6, may have a forwardly projecting portion 88 of suitable length to resiliently bias the forward portion of the seat member 34 against excessive vertical drop should the user be seated relatively forwardly in the chair 30. Moreover, the arms 54 are dimensioned and configured to provide resilient independent movement of the shoulder support members 56 thereby permitting the support members 56 to engage the upper back of the chair user even when the user rotates his or her torso while seated in the chair 30.

Figure 7:
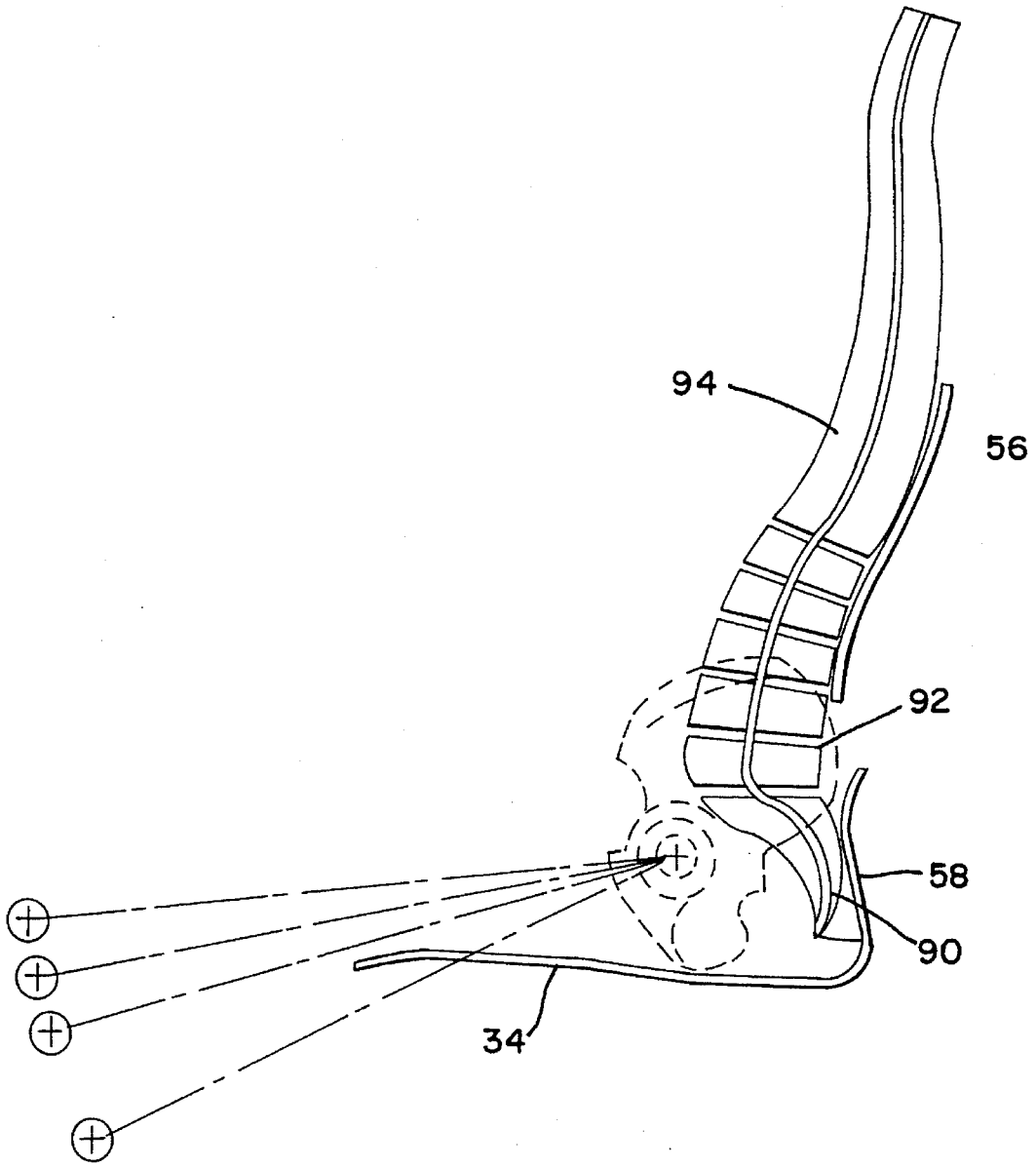
FIG. 7 is a schematic side view of the chair of the present invention illustrating the position of the spine of a person seated in the chair.

The advantages in comfort of the chair 30 may be further realized with reference to the schematic view of FIG. 7. As shown therein, the sacral support portion 58 of the seat member 34 is spaced forwardly of the arms 54 and provides for considerable support of the sacrum and ilia 90 of the chair user thereby urging the pelvis 92 of the user forwardly and maintaining an erect posture of the spine 94. Further, the chair 30 is so designed that the shoulder support members 56 of the shell 32 resiliently support the middle and upper back of the user. The shoulder supports 56 are also completely independent of the sacral support 58 and, therefore, an erect posture of the user's spine 94 is maintained even as the user shifts position of the body while seated in the chair. In a preferred form of the chair 30, the shoulder support members 56 are configured to extend upwardly to a height corresponding to the bottom of the shoulder blades of an average person and, as best seen in FIG. 1, have forwardly projecting portions 96 for engaging the bottoms of the user's shoulder blades. Accordingly, this resilient engagement of the shoulder blades of the user and provide complete support for the upper back of the user even as the user shifts position in the chair 30.

It should further be appreciated that a chair 30 of the present invention offers considerable manufacturing advantages and economies over comparable chairs of the prior art due to the relatively few parts needed to construct the chair 30. In particular, the novel construction of the yoke assembly 36 and the way in which the shell 32 is supported thereon eliminates many individual parts usually found in control mechanisms of typical chairs.

While the present invention has been described in connection with a particular embodiment thereof, it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A chair comprising:

an integrally-formed one piece shell having a generally horizontally disposed portion and a generally vertically disposed portion;

a seat member formed separately from said shell;

means formed on said horizontally disposed portion of said shell for operably connecting said seat member to said shell wherein said seat member is connected to said shell in a generally horizontal disposition; and, a sacral support member formed integrally with said seat member and extending vertically upwardly from a rear portion of said seat member, said support member being spaced forwardly of said shell;

said vertically disposed portion of said shell including a pair of independent flexible first resilient arm portions each connected to a respective shoulder support portion for independently supporting the shoulder blades of a person seated in said chair.

2. The chair of claim 1 wherein said means for connection to said seat member includes a second pair of resilient arm portions each extending laterally from a side of said horizontally disposed portion of said shell.

3. The chair of claim 2 wherein said means for connection to said seat member includes an additional arm portion extending rearwardly of said chair from said horizontally disposed portion of said shell.

4. The chair of claim 1 wherein said seat member has an edge directed forwardly of said chair and wherein a split is formed in said seat member extending rearwardly thereof from said forwardly directed edge.

5. The chair of claim 1 further including a yoke assembly connected to a base pedestal said yoke assembly being connected to said shell for supporting said shell on said base pedestal.

6. The chair of claim 5 wherein said yoke assembly includes a latch member and said latch member is provided with a slot extending laterally of said chair.

7. The chair of claim 6 wherein said shell is provided with a downwardly extending tongue and said tongue is receivable in said slot to retain said shell to said yoke assembly.

8. The chair of claim 6 wherein said slot is located forwardly of said base pedestal.

9. The chair of claim 7 wherein said tongue curves downwardly from a forward portion of said shell.

10. The chair of claim 6 wherein said yoke assembly includes a spring arm extending rearwardly of said latch member for resiliently biasing said shell against pivotal movement relative to said yoke assembly.

11. The chair of claim 1 wherein said arm portions are curvilinear.

12. The chair of claim 1 wherein said shoulder support portions have forwardly projecting edge portions to engage the back of the chair user beneath the shoulder blades.

13. The chair of claim 1 wherein said shell and said seat member are each integrally molded from an engineering polymer.

14. The chair of claim 13 wherein said polymer is glass fiber reinforced.

15. The chair of claim 14 wherein said polymer is approximately one-third glass filled.

16. A chair comprising:

an integrally-formed one piece shell having a generally horizontally disposed portion and a generally vertically disposed portion;

said vertically disposed portion of said shell including a pair of independent flexible shoulder support portions structured and dimensioned to independently support respective shoulder blades of a person seated on said chair;

a seat member formed separately from said shell and having a sacral support member formed integral therewith;

said sacral support member extending vertically upwardly from said seat member and being structured and dimensioned to engage the sacral region of a person seated on said chair; and means for connecting said seat member to said shell so that said seat member is aligned generally horizontally to said shell and said support member is spaced forwardly of said shell.

17. The chair of claim 16 wherein said means for connecting said seat member to said shell is formed on said horizontally disposed portion of said shell.

18. The chair of claim 16 further including a yoke assembly connected to a base pedestal said yoke assembly being connected to said shell for supporting said shell on said base pedestal.

* * * * *